United States Patent [19]

Bonhard

[11] 4,080,918

[45] Mar. 28, 1978

[54] RUDDER CONTROL DEVICE

[76] Inventor: Robert Bruce Bonhard, 23230 Tireman Ave., Dearborn Heights, Mich. 48127

[21] Appl. No.: 707,953

[22] Filed: Jul. 23, 1976

[51] Int. Cl.[2] ..... B63H 25/00

[52] U.S. Cl. ..... 114/172; 24/248 R; 114/170; 114/144 R

[58] Field of Search ..... 114/144 R, 144 C, 162, 114/170, 172; 115/35, 18 K, 18 A; 24/132 R, 132 WL, 248 SL, 249 SW, 252 SC, 115, 132 CS, 132 CL, 132 LP, 132 HL, 132 PT, 132 AT, 132 SL

[56] References Cited

U.S. PATENT DOCUMENTS

| | | | |
|---|---|---|---|
| 911,460 | 2/1909 | Tiley | 24/132 HL |
| 1,401,290 | 12/1921 | Taylor | 114/170 |
| 2,237,834 | 4/1941 | Landgraf | 114/144 R |
| 3,279,410 | 10/1966 | Young | 114/172 |
| 3,698,681 | 10/1972 | Lacey | 24/247 SL |
| 3,744,104 | 7/1973 | Ford | 24/248 SL |
| 3,826,213 | 7/1974 | Riebandt | 114/144 C |

FOREIGN PATENT DOCUMENTS

| | | | |
|---|---|---|---|
| 7,426 of | 1907 | United Kingdom | 24/132 HL |

*Primary Examiner*—Trygve M. Blix
*Assistant Examiner*—D. W. Keen
*Attorney, Agent, or Firm*—Barnes, Kisselle, Raisch & Choate

[57] ABSTRACT

A two-part hinge device for mounting on a tiller of a sailboat which is operable to confine and release a cross-line in a manner to lock a tiller in any desired position while the sailor is otherwise occupied.

10 Claims, 6 Drawing Figures

RUDDER CONTROL DEVICE

This invention relates to a Rudder Control Device and more particularly to a device for quickly locking or releasing a tiller in any particular position at the stern of a boat.

Very often in sailing, particularly with a one man or two man crew, it is desirable that the tiller be retained in a position while the members of the crew are otherwise occupied in controlling a sail or starting an outboard motor or doing various other chores that are necessary in a boat.

It is an object of the present invention to provide a device which can be readily attached to a tiller and which will control the position of a tiller by acting on a cross-line between the sides of the boat.

An object of the invention is to provide a simple and inexpensive structure which can be readily mounted on a tiller and which provides an attractive appearance.

It is also an object to provide a tiller control unit which is very easily operated for locking or release.

Other objects and features of the invention will be apparent in the following description and claims in which the principles of the invention are set forth, together with a description directed to persons skilled in the art on the details of construction of the device, all in connection with the best mode presently contemplated for the practice of the invention.

Figure 1:
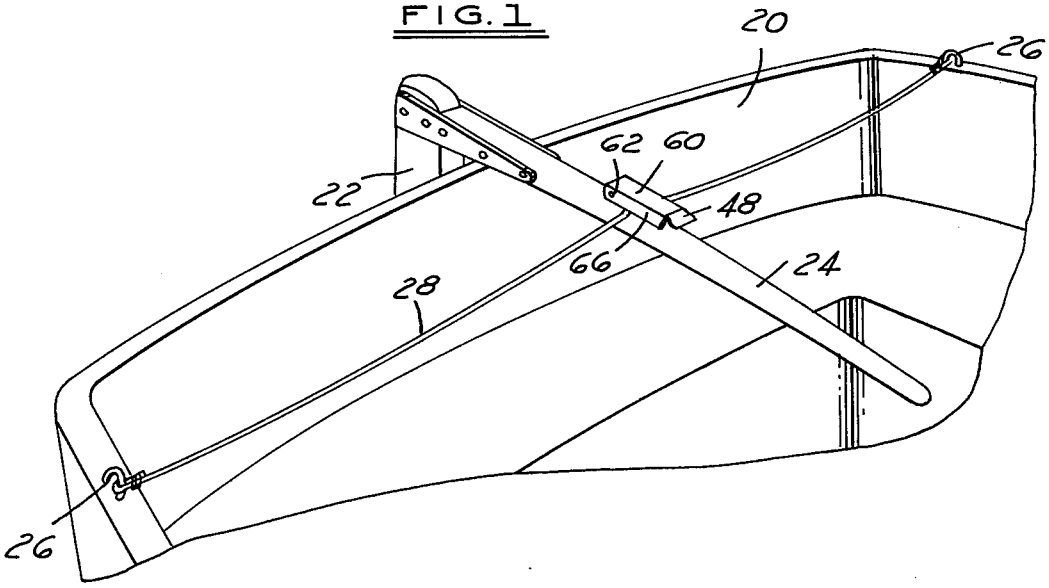

Drawings accompany the disclosure and the various views thereof may be briefly described as:

FIG. 1, a perspective view of the stern of the boat illustrating the device in operation.

Figure 2:
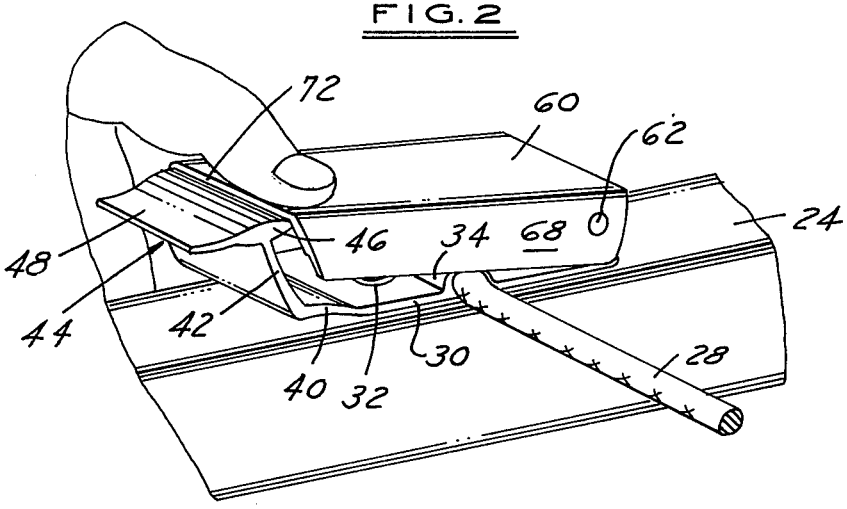

FIG. 2, a perspective view illustrating the manner in which the device is locked.

Figure 3:
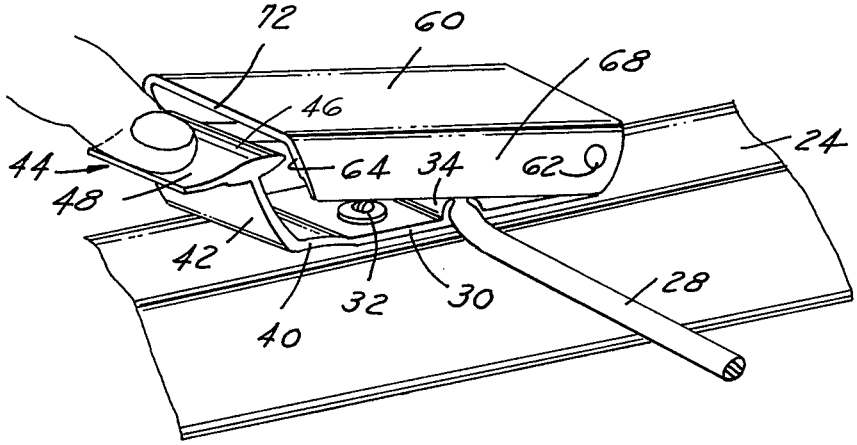

FIG. 3, a similar view illustrating the manner in which the device is released.

Figure 4:
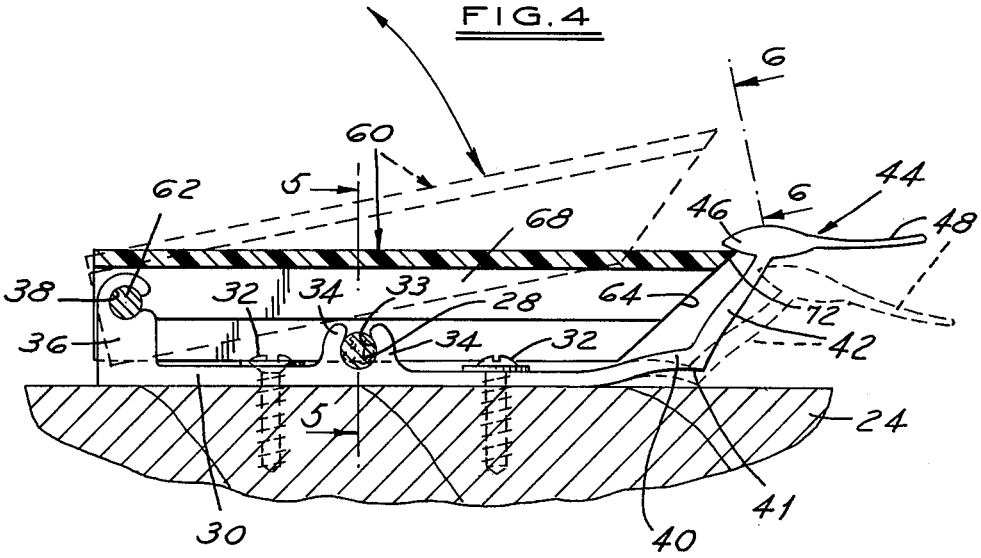
Figure 5:
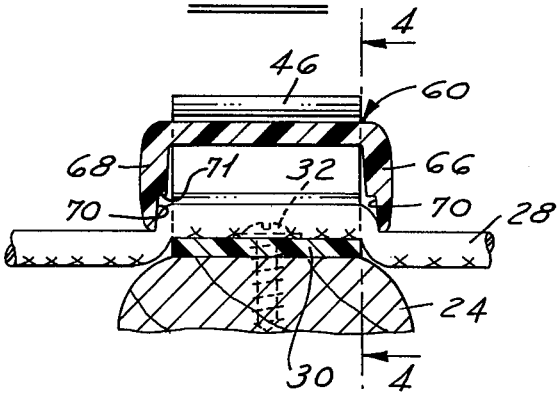

FIG. 4, a sectional view taken from one side of the device showing the details of the construction and taken on line 4—4 of FIG. 5.

FIG. 5, a sectional view taken on line 5—5 of FIG. 4.

Figure 6:
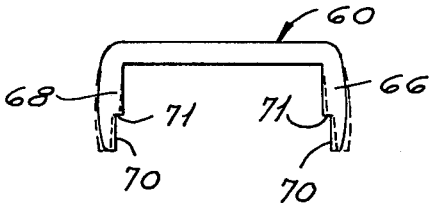

FIG. 6, an end view of the latching mechanism taken on line 6—6 of FIG. 4.

With reference to FIG. 1, the stern of a boat is shown with a transom 20 on which is mounted the tiller 22 having a tiller bar 24 extending into the boat. Extending between suitable eyelet devices 26 on the sides of the boat is a line 28. This line passes over the tiller 24 on which is mounted the releasable holding device. As shown in FIG. 4, the holding device comprises an elongate base plate 30 which is fastened to the tiller by two screws 32. Intermediate its ends, this base plate has a transverse round channel 33 formed by two upstanding elongate bosses 32. The line 28 is threaded through the top opening in this channel 33 and releasable through the space between the top of the bosses 34.

The left-hand end of the base, as shown in FIG. 4, has an upstanding foot portion 36 which has a cylindrical opening 38 extending therethrough from side to side, this serving as a pivot bearing for the top of the element to be described. At the right-hand end of the base as shown in FIG. 4 is a latch mechanism comprising a resilient leaf portion 40 which is curved upwardly at a low angle from the surface of the tiller away from the base of the plate 30 but extending generally in a horizontal direction terminating at the lower surface in a heel portion 41. Rising from this leaf portion 40 is a secondary extension portion 42 which rises at a higher angle and terminates in a head portion 44 which has an inwardly extending latch projection 46 and an outwardly extending pressure plate 48.

The second portion of the two piece device is a U-shaped cover plate 60 which is shown in FIG. 4 as having a square end at the left carrying pivot pin 62 between the sides. This pin is mounted in the opening 38 in the bearing foot 36. The pin 62 is recessed into holes in the sides 66, 68 of the cover 60. The right-hand end of the cover is angled upwardly as shown at 64. The sectional view of the cover member 60, shown in FIGS. 5 and 6, illustrates the sides 66 and 68 extending downwardly and having notched recesses 70 terminating in shoulders 71 on the inner surfaces.

In FIG. 5, the locking position of the cover is illustrated wherein the line 28 is trapped over the base plate 30 by the side walls 66 and 68. The upper corners of the plate 30 are preferably reasonably sharp without having a cutting edge so that the line 28 will be securely captured when the cover 60 is moved down onto the plate. The free end of the cover 60 will be held in the downward position by the latch portion 46 as shown in FIG. 4.

Downward pressure on the pressure release plate 48 will free the cover so that it may spring upwardly and the line 28 may then be freely moved through the transverse opening in the base. In the locking position shown in FIG. 5, the sides 66 and 68 will be sprung outwardly slightly from the at rest position. The two positions are shown in FIG. 6, the dotted lines showing the position assumed by the sides when locking.

In FIG. 2, the device is shown being moved toward a locking position where the thumb on the free end of the top 60 is pushing the top down so that it will latch under the position 46. In FIG. 3, the release operation is shown wherein pressure on the release plate 48 moves the latch portion away from the front edge 72 of the top 60 so that the top can move upwardly.

It will be appreciated that the parts 30 and 60 can be made of any number of materials. A molded plastic material has proved to be successful in a practical device. The release action caused by pressure on the plate 48 causes a resilient movement of the leaf portion 40 until the heel portion strikes the supporting surface. The riser portion 42 may then flex. This prevents the bending forces in the unit from being concentrated at any one particular point.

It will thus be seen that in operation, the line 28 will thread freely through the channel 33 and base 30 so that the tiller can be manipulated very readily even when the line is in this position. If desired, the line can be released from the channel 33 to allow more freedom of movement. When it is desired to control the tiller in a position, the line is threaded into the transverse channel 33 of the base and the top 60 is pushed down until it latches into the locking position shown in FIG. 5.

While the tiller mount position is most convenient, the device might be used by mounting on the side of the boat and using a continuous loop across the boat which has one side affixed to the tiller.

What I claim is:

1. In combination for controlling a boat which comprises:

(a) a movable tiller bar for controlling rudder position on a boat, (b) an elongate base for a tiller control device mounted on said tiller bar, said base having a transverse open topped channel having a reentrant groove to guide a tiller line across the base, (c) a latch member manually movable to and from a latching position at one end of said base plate, (d) a clamping cap hinged to said base on an axis spaced from said latch having means to engage a portion of said line in said channel to lock it against lateral movement relative to said base, and (e) means on said cap to engage said latch to retain said cap in latched position until manually released.

2. A combination for controlling a boat as defined in claim 1 in which said latch comprises a flexible leaf portion rising from said base having a ledge portion to engage a clamping cap, and said clamping cap comprises an inverted U-channel having resilient sides to move in latched position to overlie the ends of said line channel to lock a line against movement in said channel and having an end portion to underlie said latch ledge in latched position to retain said cap until said left portion is manually flexed to a release position.

3. In combination for controlling a boat which comprises:

(a) a movable tiller bar for controlling rudder position on a boat, (b) an elongate base for a tiller control device mounted on said tiller bar, said base having a transverse open topped channel having a reentrant groove to guide a tiller line across the base, (c) a latch member manually movable to and from a latching position at one end of said base plate, (d) a clamping cap hinged to said base on an axis spaced from said latch having sides to move laterally into a latched position across the ends of said tiller line channel to lock a line in said channel, and (e) means on said cap to engage said latch to retain said cap in latched position until manually released.

4. A tiller control device to be mounted on a boat to releasably lash a tiller line which comprises:

(a) a molded elongate base plate having a transverse open-topped channel to removably guide a tiller line across said base, (b) a resiliently movable latch molded on one end of said base plate rising in a flexing leaf portion from said base and having a latch ledge and release plate horizontally disposed at the distal end of said leaf, (c) a clamping cap hinged to said base at an end opposite said flexing leaf having flexing sides to move laterally across the ends of said tiller line channel to entrap a line in said channel, and (c) means on said clamping cap to engage said latch ledge to hold said cap in locked position until said flexing leaf is flexed by manipulation of said release plate.

5. A control and locking device for a line which comprises:

(a) an elongate base to be fastened to a support having a top surface joining upstanding side edges in a relatively sharp corner on each side, (b) means at each end of said base to confine a line passing transversely over the base, (c) a top line locking means extending along said base pivotally connected at one end to one end of said base and having sides to position directly adjacent the side edges of said base in a locking position to bind a line downwardly over and in contact with said side edges, and (d) latch means integral with said confining means at one end of said base to engage one end of said line locking means opposite said pivoted end to retain said line locking means in the line confining position, said latch means being capable of being flexed to a releasing position to allow said line locking means to pivot upward to release a line.

6. A tiller control device to lock a line connecting the tiller to a position of a boat which comprises a base part to be mounted on a portion of a boat, a locking part connected to said base and movable manually to a locking position and a release position relative to said base, means to guide a tiller line through said parts, and means on said parts to clamp said line against motion through said parts when the locking part is manually moved to a locking position, said base part and said locking part being hinged together and said base part comprising a plate to be fastened to a portion of the boat having a transverse line guide intermediate its ends, and a resilient riser extension at one end of said plate having a horizontally extending transverse latch portion branching from the riser extension to overlie a transverse portion of said locking part in locking position.

7. A tiller control as defined in claim 5 in which said resilient riser extension of said plate comprises a first low rising portion and a secondary riser portion extending to the said transverse latch portion, and a pressure plate branches from said latch portion in the same direction as said riser portions for the application of manual pressure to facilitate release.

8. A tiller control device which comprises a base part to be mounted on a portion of a boat, a locking part movably associated with said base to a locking position and a release position, means to guide a tiller line through said parts, and manually operable means on said parts to clamp said line against motion through said parts when the locking part is in locking position, said base part and said locking part being hinged together and said locking part comprising a U-shaped inverted channel member having depending sides to overlie portions of said base part and the ends of said guide means to clamp a line against said portions when in locking position.

9. A tiller control device which comprises a base part to be mounted on a portion of a boat, a locking part movably associated with said base to a locking position and a release position, means to guide a tiller line through said parts, and manually operable means on said parts to clamp said line against motion through said parts when the locking part is in locking position, said base part comprising a base plate to be fastened to a portion of the boat, and said locking part comprising an inverted elongate channel hinged at one end to said base plate and having depending sides to clamp a line against the edges of said base plate to resist transverse motion of a tiller line through said guide means.

10. A tiller control device as defined in claim 9 in which said depending sides of said channel are resilient to exert pressure against a tiller line.

* * * * *

UNITED STATES PATENT AND TRADEMARK OFFICE

CERTIFICATE OF CORRECTION

PATENT NO. : 4,080,918

DATED : March 28, 1978

INVENTOR(S) : Robert Bruce Bonhard

It is certified that error appears in the above-identified patent and that said Letters Patent are hereby corrected as shown below:

Claim 4 (Col. 3, Line 50), change (c) to (d).

Claim 6 (Col. 4, Line 11), change "position" to "portion".

Claim 7 (Col. 4, Line 27), change "5" to "6".

Signed and Sealed this

*Eighth* Day of *August 1978*

[SEAL]

*Attest:*

RUTH C. MASON
*Attesting Officer*

DONALD W. BANNER
*Commissioner of Patents and Trademarks*